United States Patent [19]

Stark et al.

[11] 3,957,473

[45] May 18, 1976

[54] MIXED REFRIGERANT CYCLE

[76] Inventors: Thomas M. Stark, 22 Lynfield Drive, Morristown, N.J. 07960; Sheldon Bodnick, 33 Old Middletown Road, Rockaway, N.J. 07866

[22] Filed: Sept. 9, 1974

[21] Appl. No.: 504,105

Related U.S. Application Data

[63] Continuation-in-part of Ser. No. 309,341, Nov. 24, 1972, Pat. No. 3,884,045, and a continuation-in-part of Ser. No. 9,500, Feb. 9, 1970, abandoned.

[52] U.S. Cl. ..... 62/9; 62/40; 62/114

[51] Int. Cl.[2] ..... F25J 3/02

[58] Field of Search ..... 62/9, 11, 23, 26, 30, 62/40, 27, 28, 510

[56] References Cited

UNITED STATES PATENTS 3,593,535 7/1971 Gaumer et al. ..... 62/23

*Primary Examiner*—Norman Yudkoff
*Assistant Examiner*—Frank Sever
*Attorney, Agent, or Firm*—Harold N. Wells; F. Donald Paris

[57] ABSTRACT

A process for cooling and condensing natural gas in a plurality of convective heat exchange stages by means of multicomponent refrigerants. The first refrigerant cools the natural gas and the second refrigerant from ambient temperature in a first heat exchange stage. Then the second refrigerant cools the natural gas further in a second stage and afterward is compressed while still below ambient temperature to an intermediate pressure where it is joined by the first refrigerant for further compression and cooling to ambient temperature before separating the two refrigerants and repeating the refrigeration cycle.

2 Claims, 5 Drawing Figures

MIXED REFRIGERANT CYCLE

CROSS-REFERENCE TO RELATED APPLICATIONS

This application is a Continuation-in-Part of application Ser. No. 309,341, filed Nov. 24, 1972, now U.S. Pat. No. 3,884,045, which was a Continuation-in-Part of application Ser. No. 9,500, filed Feb. 9, 1970, now abandoned.

BACKGROUND OF THE INVENTION

In the prior art, several methods are employed for the liquefaction of natural gas feeds. Among these is a multicomponent refrigeration cycle in which natural gas feed at ambient temperature, normally of about 100°F. is successively cooled and liquefied in a plurality of heat exchange stages, resulting in a liquefied natural gas product at a temperature of about −260°F. The cooling medium is a multicomponent refrigerant.

In the prior art method, the multicomponent refrigerant, having given up its residual cold in a first heat exchange stage, enters a compressor in the vapor phase, at a pressure of about 1–5 atmospheres and a temperature essentially ambient. By ambient temperature is meant the average temperature of the surrounding environment and thus, as applied to process streams, it is the temperature which can be closely approached by contacting those streams with the air, water, etc. The refrigerant is pressurized and cooled by heat exchange with water or air to form a two-phase mixture at a temperature slightly above ambient. This two-phase mixture is cycled to a separation drum upstream of the first heat exchange stage. The two phases are separated in this drum and both vapor and liquid phases enter the first heat exchange stage along with the natural gas feed. All of the above three streams are cooled by the recycled multicomponent refrigerant stream. This recycled refrigerant stream enters the first heat exchange stage as a two-phase mixture countercurrent to the three streams, generally at a temperature 0°F. or below. In the course of cooling the three streams, the recycled refrigeration stream is warmed, exiting as a gas as discussed above at a temperature about ambient. Typical of the prior art method is U.S. Pat. No. 3,593,535 to Gaumer et al.

The disadvantages of this prior art method lie first in the high power requirements of the refrigeration compression step. A second disadvantage is the high capital cost of heat exchange stages. All the heat exchange stages in the prior art method are constructed of high cost alloy materials. This is necessary in order to insure that all heat exchangers and heat exchange stages operate without danger of rupture in the low temperature environment that they are subjected to in the prior art process.

SUMMARY OF THE INVENTION

The method of the instant invention is directed to a process for cooling and condensing natural gas by means of multicomponent refrigerant mixtures. The instant invention is an improvement over prior art methods in that a multicomponent refrigerant does not pass through the first heat exchange stage, but instead enters the compression stage at a much lower temperature than the ambient temperature used in the prior art method. This results in a process in which less power is required since the inlet temperature to the compressor is reduced. Since the work of additional refrigeration required to replace the cooling done in the prior art by the refrigerant stream in the warmest (first) heat exchange stage is less than the work saved by lowering the compressor suction temperature, the process of the instant invention results in considerable power savings.

The instant invention is also directed to a process in which the capital costs are lower than the equivalent prior art process. Thus, in the instant invention, the first heat exchange may be constructed of carbon steel rather than high cost alloy materials. This is due to the method of the instant invention wherein the first heat exchange stage is no longer subject to a refrigerant stream temperature so cold that carbon steel is not suitable.

In accordance with the instant invention, a first mixture, i.e the natural gas feed is cooled and condensed in a series of heat exchange stages by means of a second mixture which acts as a refrigerant. The second mixture is separted into liquid and gaseous phases after leaving the compressor and the two single phase second mixture streams are passed cocurrently through a first heat exchange stage with the first mixture wherein all three streams are cooled. Since all three streams are cooled by environmental streams, e.g. air and water before entering the first heat exchange stage, they enter near ambient temperature and they leave the first stage below ambient temperature. Thereafter, the first mixture and at least portions of the liquid and gaseous phases of the second mixture are further cooled in a second heat exchange stage by means of a cold recycle of the refrigerant. The gaseous phase of the second mixture which is cooled in the second heat exchange state is again separated into gaseous and liquid phases. The steps of cooling the first mixture and the liquid and gaseous phases of the second mixture by means of a cold recycle of the second mixture and then separating the cooled gaseous phase of the second mixture into liquid and gaseous phases is repeated until the first mixture is cooled and condensed to the desired temperature. The cold recycle of the second mixture after exiting the second heat exchange stage as a gas is compressed while still below ambient temperature and then cooled and cycled back into the separator stage wherein the second mixture is separated thus completing the cycle. The refrigeration value lost by recycling the cold second mixture is supplied by one of several alternative methods.

In a preferred embodiment, the first and second mixtures are cooled in the first exchange stage by means of a separate refrigeration cycle using, instead of a multicomponent mixture, an essentially single component refrigerant.

In another preferred embodiment, the cold recycle exiting the second heat exchange stage is compressed in two stages to provide a subsidiary refrigeration loop. A portion of the second mixture is compressed to an intermediate pressure, cooled to near ambient temperature, and then used in the first heat exchange stage to provide the cooling for the remainder of the second mixture and all of the first mixture.

In still other preferred embodiments, all or a portion of the second mixture after leaving the first heat exchange stage is flashed and recycled back through the first heat exchange stage thus providing a third means of cooling the first and second mixture in the first heat exchange stage.

The method of the instant invention requires less power since the recycle stream is compressed after leaving the second heat exchange stage at a low temperature rather than at ambient temperature as typical in the prior art in which is continued on through the first heat exchange stage.

Additionally, since the cold recycle is sent to the compressor after leaving the second heat exchange stage, the first heat exchange stage is designed with a separate cooling system which is independent of the colder temperatures existing downstream in the other heat exchange stages. Hence, the first heat exchange stage may be constructed of carbon steel since the temperature in the first heat exchange stage can be designed to never encounter temperatures below −10°F.

BRIEF DESCRIPTION OF THE DRAWINGS

The invention may be better understood by reference to the accompanying drawings in which.

DESCRIPTION OF THE PREFERRED EMBODIMENT

Figure 1:
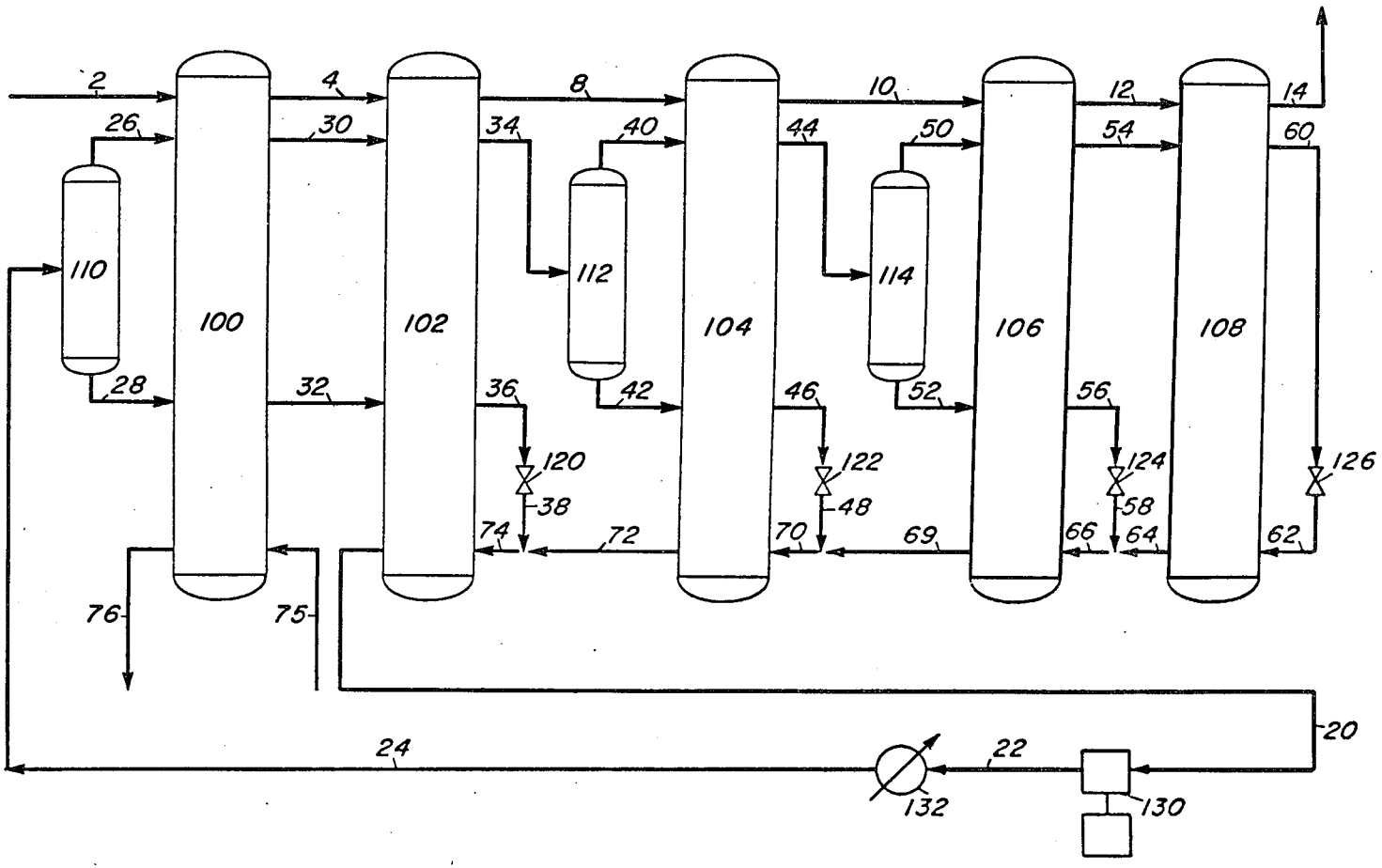
FIG. 1 is a flow diagram of a multicomponent refrigeration cycle with cooling in the first heat exchange stage provided by an external refrigerant.

Referring to FIG. 1, in detail, reference numeral 2 denotes a conduit supplying a first mixture, which in a preferred embodiment is a natural gas multicomponent feed stock at about ambient temperature, typically about 100°F., into a first heat exchange stage 100. If the gas is not already at near ambient temperature, it will be precooled by indirect heat exchange against environmental streams, usually air or water, since this is more economical than cooling by refrigeration. A second mixture which comprises a multicomponent mixtue of nitrogen, methane, ethane, propane, butane and heavier hydrocarbons leaves a compressor 130 through a conduit 22 as a gaseous mixture at a pressure of about 350–550 pounds per square inch. The high pressure refrigerant stream thereafter is cooled to near ambient temperature and partially condensed in an aftercooler 132. This second mixture then flows through a conduit 24 into a separation drum 110 wherein the two phases are separated. The gaseous phase of the second mixture contained in drum 110 is next conveyed to the first heat exchange stage 100 by way of a conduit 26 at the drum equilibrium conditions. The liquid phase of the second mixture enters the first stage 100 at the same conditions as the second mixture gas from the drum 110 through a conduit 28.

The three above-described streams, the first mixture gaseous stream, and the two single-phase second mixture streams entering stage 100 through conduit 2, 26 and 28 respectively are cooled by convective heat transfer. In a preferred embodiment, illustrated in FIG. 1, a plurality of cooling streams are employed to cool these streams. Each of these cooling streams comprise an essentially single component refrigerant operating at a different pressure from the others so that a plurality of boiling temperatures for the same refrigerant is attained. This permits convective cooling of the three above-described streams by means of a separate refrigeration cycle which removes heat from the ambient temperature incoming streams and rejects it to the environment. The temperature range suggests that propane would be a preferred refrigerant. The separate refrigerant enters the stage 100 either cocurrently or countercurrently (shown in FIG. 1 as a counter-current stream) to the streams that are cooled therein. The refrigeration streams exit stage 100 through a conduit 76 as a vapor near or slightly below ambient temperature. It is recompressed, cooled and recycled by means of a separate external refrigeration cycle, which is not shown in the drawing, and again supplied to the first heat exchange stage 100 as a two-phase stream through a conduit 75.

The first mixture is cooled in the first heat exchange stage 100 to a temperature in the range of 0° to 60°F. The first mixture leaves exchange stage 100 via conduit 4. The second mixture gaseous and liquid phase streams are cooled in stage 100 to a temperature of about 0° to 60°F. The gaseous stream entering through conduit 26 is partially condensed in stage 100. The second mixture streams exit respectively via conduits 30 and 32.

The three streams, that is, the first mixture stream, the second mixture two-phase stream and the second mixture liquid stream are further cooled in a second heat exchange stage 102. Again, they enter this stage cocurrently by way of conduits 4, 30 and 32 respectively. The first mixture gaseous stream is chilled in stage 102 to a temperature of about −30° to −50°F. exiting said stage 102 through a conduit 8. The second mixture gaseous stream is cooled and partially condensed in stage 102 exiting through a conduit 34 at a temperature of about −30° to −50°F. The second mixture liquid stream is also cooled to a temperature of about −30° to −50°F. This cooled liquid stream exits through a conduit 36.

The cooling medium for these three above-described cocurrent streams comprises, in part, the liquid phase of the second mixture exiting through conduit 36. Conduit 36 leads the liquid phase stream into an expansion valve 120. The liquid is therein flashed resulting in a two-phase mixture at an approximate temperature of about −35° to −70°F. The two-phase flased stream flows from the expansion valve 120 into a conduit 38. This stream thereupon enters a conduit 74, where it mixes with an exiting multicomponent second mixture stream from a downstream heat exchange stage 104. This combined recycle stream flows through conduit 74 into stage 102 at a temperature of about −35° to −70°F. This two-phase second mixture stream is warmed in the second stage 102, thereby vaporizing the mixture. The recycle stream leaves the stage 102 as a gas through a conduit 20 at a temperature in the range of −20°F. to 10°F. and a pressure of 1 to 5 atms. The stream flows through conduit 20 back to the compressor 130. As will be described hereinafter, the second mixture recycle stream includes second mixture streams recycled from downstream heat exchange stages. Therefore, by material balance, the second mixture vapor stream in conduit 20 includes all of the second mixture that enters into the second heat exchange stage 102 through conduits 30 and 32.

In another preferred embodiment, the liquid phase of the second mixture exiting heat exchange stage 100 through conduit 32 is immediately flased and passed through heat exchange stage 102 countercurrent to the first mixture stream and the vapor phase of the second mixture entering stage 102 through conduits 6 and 30 respectively. It should be appreciated that this alternative method may be applied to any or all of the heat exchange stages in which the liquid phase of the second mixture is flashed and passed countercurrently to the first mixture. This alternate method is applicable not only to the FIG. 1 embodiment but to the embodiments disclosed in FIGS. 2 and 3 hereinafter.

The first mixture in conduit 8 next enters the third heat exchange stage 104 at a temperature of about −30°F. to −50°F. A second cocurrent stream enters heat exchange stage 104 through a conduit 40. This stream represents the overhead vapor phase of the second mixture contained in a separation drum 112. The contents of drum 112 comprises the two-phase mixture exiting stage 102 through conduit 34. Thus, this gaseous stream enters at the same thermodynamic conditions as existed in conduit 34, namely a temperature of about −30°F. to −50°F. A third inlet stream into stage 104 is the liquid phase of the second mixture contained within drum 112. It enters stage 104 through a conduit 42 at the same thermodynamic conditions as the gaseous stream entering through conduit 40. The three streams are again cooled by a flashed recycle stream of the second mixture which flows countercurrently in stage 104 to the above-described streams. Thus, the liquid phase stream exiting stage 104 is chilled to an approximate temperature of −100° to −130°F. This stream exits stage 104 into a conduit 46 which leads the liquid stream into an expansion valve 122 wherein the liquid is flashed resulting in a two-phase mixture at a temperature of about −105° to −150°F. This two-phase stream leaves valve 122 to enter a conduit 48 which is in communication with a cooling stream exiting a fourth heat exchange stage 106.. The two streams combine to form a two-phase multicomponent second mixture stream which enters heat exchange stage 104 through a conduit 70 countercurrent to the three above-described streams which enter stage 104 cocurrently. This results in cooling of the first mixture stream to a temperature of about −100° to −130°F. The chilled first mixture stream exits through a conduit 10. The second mixture gaseous stream is cooled and condensed in the third heat exchange stage 104 to a temperature of −100° to −130°F. At these conditions, the second mixture two-phase stream exits stage 104 through a conduit 44 into a separation drum 114.

The same procedure is followed in the fourth heat exchange stage 106. That is, three streams enter stage 106 cocurrently and are cooled therein by a flashed recycle stream which flows countercurrently to the three streams. The first mixture stream, at the entering temperature of −100° to −130°F. is condensed in stage 106. This first mixture liquid stream leaves stage 106 through a conduit 12 at a temperature of approximately −170° to −210°F. The two single-phase second mixture streams are similarly cooled to approximately −170° to −210°F. The gaseous second mixture stream which flows from the drum 114, at a temperature of about −100° to −130°F., through a conduit 50 into stage 106 is totally condensed therein. The condensed liquid phase second mixture stream exits stage 106 through a conduit 54. The third inlet stream to stage 106 is a liquid phase second mixture stream which exits the drum 114, also at the equilibrium temperature range of −100° to −130° F., through a conduit 52 is cooled and exits through a conduit 56. Conduit 56 leads to an expansion valve 124 wherein the liquid is flashed resulting in a two-phase stream at a temperature of about −170° to −230°F. The two-phase second mixture stream exits valve 124 through a conduit 58 which connects with a downstream recycle second mixture stream contained in a conduit 64. This combined stream, at approximately the same temperature and pressure as the flashed stream exiting valve 124, flows in a conduit 66 which leads the two-phase stream into the fourth heat exchange stage 106. The stream flows countercurrently to the above-described streams, entering stage 106, and exits through a conduit 69 as a two-phase stream at a temperature of about −105° to −150°F.

Since the gaseous second mixture stream is totally condensed in stage 106, there is no separation step between the adjoining two heat exchange stages 106 and 108. Thus, there are only two streams cooled in a fifth and last heat exchange stage 108. They are, the liquid first mixture stream which enters through the conduit 12 and the second mixture liquid stream which enters through the conduit 54. Again, they enter cocurrently and are cooled by a second mixture two-phase stream which flows countercurrently to these two streams. Both streams are cooled by the second mixture two-phase stream which consists of the second mixture liquid stream which exits exchange stage 108 through a conduit 60. The liquid contained within conduit 60 is flashed in an expansion valve 126. This results in a two-phase stream at a temperature below −260°F. The two-phase stream flows from the valve 126 into a conduit 62 which leads the stream through the stage 108 countercurrently to the two liquid streams. This recycle stream is heated, exiting the stage 108 through the conduit 64 as a two-phase mixture at a temperature of about −170° to −230°F.

The first mixture liquid stream is cooled in exchange stage 108 to a temperature of about −260°F. This stream exits through a conduit 14, which leads to either a point of usage or a storage facility. This stream comprises the final liquefied natural gas product of the above-described method. The second mixture liquid stream is similarly cooled to about −260°F., exiting through a conduit 60 to the expansion valve 126.

It should be appreciated that convective heat transfer between streams occurs in heat exchange stages. It should not be inferred that a heat exchange stage is equivalent to a single heat exchanger. On the contrary, a heat exchange stage should be understood to include one or more heat exchangers of various kinds which may be disposed in parallel and/or series configurations. This interpretation should be given also to the disclosure which follows.

Figure 2:
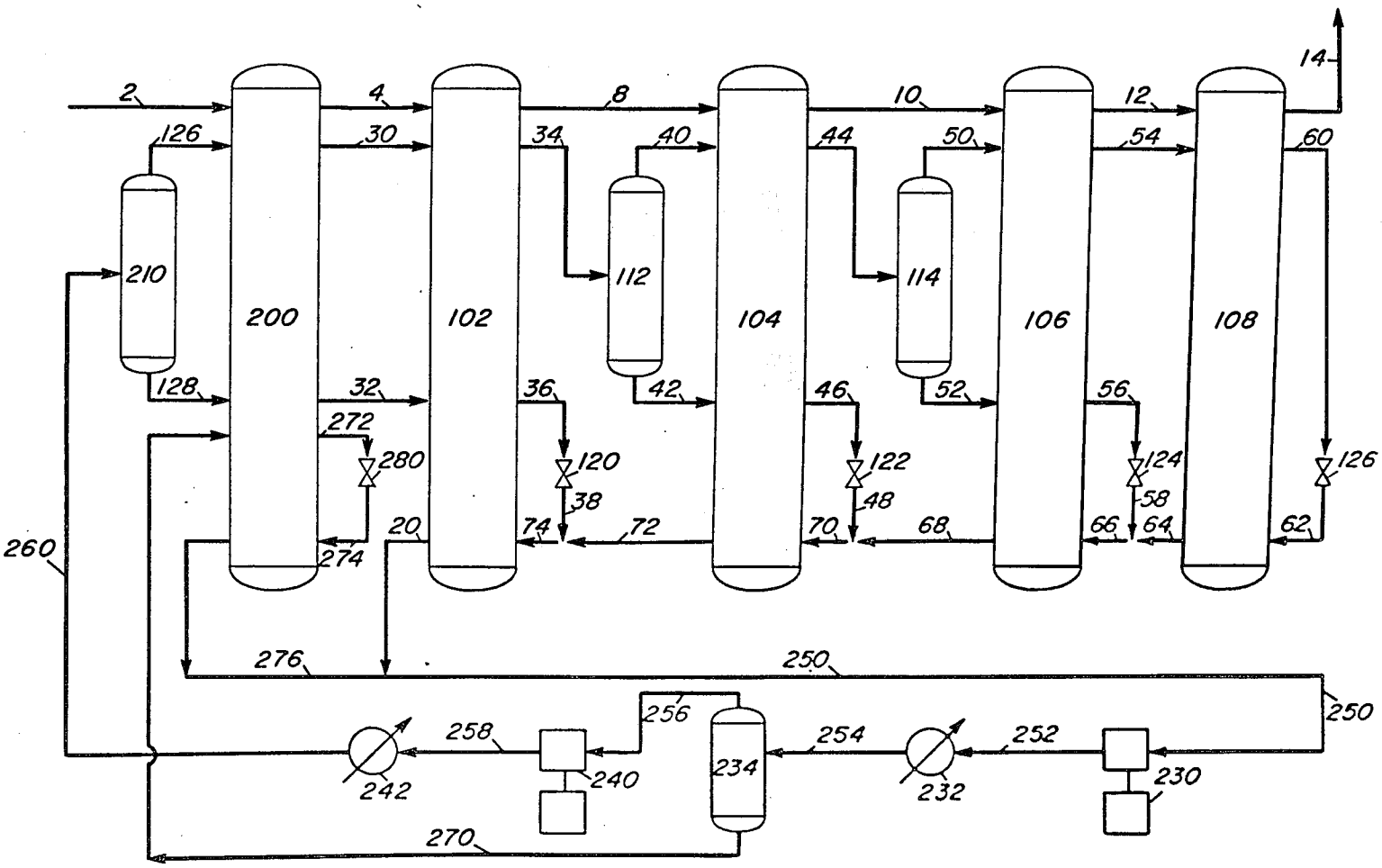
FIG. 2 is a flow diagram of a multicomponent refrigeration cycle with cooling in the first heat exchange stage provided by expansion of an intermediate pressure second mixture liquid.

Turning now to FIG. 2 in detail, in another preferred embodiment of this invention, a first mixture which in a preferred embodiment is a natural gas feed comprising in the main, light hydrocarbons, enters a first heat exchange stage 200 through a conduit 2 at near ambient temperature, typically about 100°F. A multicomponent second mixture, which acts as a refrigerant enters stage 200 through a series of steps starting at a first compressor 230. The multicomponent second mixture leaves the compressor 230 through a conduit 252 as a gas at a pressure of approximately 100 to 200 psia. This stream thereupon is cooled in intercooler 232 wherein the temperature is reduced to approximately 100°F. by indirect heat exchange against air or water at ambient temperature, thereby condensing the higher boiling components of the multicomponent second mixture. Thus, a two-phase multicomponent mixture flows out of intercooler 232 into a conduit 254. This second mixture thereupon flows into a stage knockout drum 234 wherein the phases are separated. The gaseous phase constituent contents of drum 234 is further pressurized in a second stage compressor 240. The gaseous phase stream enters compressor 240 from the drum 234 by way of a conduit 256 at an approximate temperature of 100°F. and a corresponding pressure of about 100 to 200 psia. Upon leaving compressor 240, the gaseous stream has been pressurized to about 350 to 550 psia. This second mixture gaseous phase stream is then cooled by indirect heat exchange against air or water at ambient temperature in an aftercooler 242 by way of a conduit 258. Part of the gas stream second mixture is condensed therein resulting in a two-phase mixture at a temperature of about 100°F while maintaining a constant pressure of about 350 to 550 psia. The two-phase mixture exits aftercooler 242 by way of a conduit 260. Conduit 260 is in communication with a separation drum 210. The two phases are separated therein and conveyed in separate streams into the first heat exchange stage 200. Both the gaseous stream and the liquid stream enter stage 200 at the drum 210 equilibrium conditions of approximately 100°F. and 350 to 550 psia. The second mixture gaseous and liquid streams enter stage 200 through conduits 126 and 128 respectively. The two second mixture streams along with the first mixture gaseous stream all enter exchange stage 200 cocurrently.

The cooling stream for the above single phase streams is provided by the second mixture liquid phase of the stage knockout drum 234. This second mixture liquid phase, at a temperature of about 100°F. is conducted by means of a conduit 270 into the first heat exchange stage 200. This stream flows cocurrently with the three abovementioned streams in stage 200 exiting said stage 200 through a conduit 272 at a temperature of about 60°F. Conduit 272 is in communication with an expansion valve 280. The liquid stream is therein flashed resulting in a two-phase mixture at a temperature of about 0° to −30°F. A conduit 274, in communication with the valve 280 and the stage 200, leads the two-phase mixture to the heat exchange stage 200 countercurrently with the aforementioned streams. The second mixture two-phase stream is warmed in stage 200 and vaporized, exiting at a temperature near ambient, slightly below 100°F. Thus, the latent heat of vaporization of the two-phase mixture is the primary cooling source for the four cocurrent streams which are cooled. This second mixture gaseous stream leaves stage 200 through a conduit 276 and joins the main refrigerant stream of line 20.

This procedure may be slightly modified to produce slightly less efficient results at lower capital cost. This alternate embodiment excludes the precooling of the liquid in the drum 234. Instead the liquid in drum 234 is again conveyed by a conduit directly to an expansion valve. The liquid is therein flashed and passed into the heat exchange 200 as a two-phase stream. Again, the two-phase countercurrent cooling stream is vaporized in stage 200 and exits through conduit 276.

The exiting second mixture stream in conduit 276 merges with conduit 20 to form a new conduit 250. The contents of conduit 20, namely the gaseous second mixture stream exiting the second heat exchange step 102, has been previously thermodynamically defined in the description of the embodiment illustrated in FIG. 1. The combined stream in conduit 250 is a gas at a temperature considerably below ambient and a pressure of 1 to 5 atmospheres. This gaseous stream returns now to the first stage compressor 230 and is compressed thereby completing the cycle.

The streams entering the first heat exchange 200 cocurrently are cooled to about 0° to 60°F. Thus, they are cooled to the same extent as was previously described in FIG. 1. Therefore, they have been given the same reference numerals as assigned in the embodiment illustrated in FIG. 1. All reference numerals of conduits, heat exchange stages, separation drums and the like are the same in FIG. 2 as in FIG. 1 when the thermodynamic conditions in such conduits, stages, drums and the like are similar to the corresponding equipment in FIG. 1. Therefore, the reference numerals of most of the equipment downstream of the first heat exchange stage have not been changed in FIG. 2. For this reason, a detailed description of FIG. 2 downstream of the first heat exchange stage is not included. This is not to say that the conditions of all streams with the same number are exactly the same as the same numbered streams in FIG. 1. It is to say that conditions are approximately the same so that the use of the same numbers are justified in view of the insignificant changes in thermodynamic properties in the same numbered streams. It should further be appreciated that those streams, separators and the like upstream of the second heat exchange stage which are numbered with the same numbers in FIG. 2 as in FIG. 1 are subject to the same interpretations. The above remarks are applicable to the embodiment illustrated in FIG. 3 hereinafter.

In a third preferred embodiment illustrated in FIG. 3 a first mixture, again a gaseous feed stream exactly the same as the feed stream previously described in the previous embodiments, enters a first heat exchange stage 300 through conduit 2. It is cooled in the first heat exchange stage 300 and exits through a conduit 4. It should be understood that the temperature, pressure and other properties of the first mixture gaseous stream are the same as previously disclosed in the embodiments illustrated in FIGS. 1 and 2.

Two additional streams enter the first heat exchange stage 300 cocurrently with the first mixture stream entering through conduit 2. These two streams represent a second mixture gaseous stream and a second mixture liquid stream. These two streams originate at the downstream end of a compressor 330. A second mixture gaseous stream exits the discharge end of compressor 330 at a pressure of about 350 to 550 psia. This stream flows through a conduit 340 in communication with the discharge end of compressor 330 and also in communication with the inlet of aftercooler 332. The stream flows through aftercooler 332 thereby cooling and partially condensing the second mixture gas stream. The two-phase stream exits aftercooler 332 through a conduit 342 at a temperature of about 100°F.

and a pressure still at about 350 to 550 psia. Conduit 342 leads the two-phase stream into a separation drum 310 in which the liquid and gaseous streams are separated and separately led into the first heat exchange 300. Thus, the second mixture gaseous stream enters stage 300 through a conduit 344 while the second mixture liquid stream enters said stage 300 through a conduit 346. These two single phase second mixture streams flow into stage 300 cocurrently with the first mixture gaseous stream entering through conduit 2. The three streams are all cooled to a temperature of about 0° to 60°F. by means of a portion of the second mixture liquid stream exiting stage 300. The chilled second mixture liquid stream leaves stage 300 through conduit 31. A portion of this stream is bypassed into a conduit 331 which leads the liquid stream into an expansion valve 380. The fraction of the liquid stream in conduit 31 which is by-passed into conduit 331 is 10 to 40%. Thus, only 60 to 90% of the liquid stream exiting conduit 31 enters the second heat exchange stage 102. The fraction of the second mixture liquid stream flowing into stage 102 enters by way of a conduit 33. The liquid stream is flashed and partially vaporized in valve 380 exiting said valve 380 at a temperature of about 0° to −30°F. in a conduit 374. Conduit 374 leads the two-phase second mixture stream back into stage 300 countercurrently to the three inlet streams.

The recycled second mixture stream is warmed in stage 300 exiting said stage 300 as a gas at a temperature near ambient slightly below 100°F. through a conduit 376. Conduit 376 leads the gaseous second mixture stream to a downstream stage of the compressor 330. It should be understood that this stream enters a stage downstream of the inlet of the compressor 330 since it is at a higher pressure than the stream entering the inlet of said compressor 330. Thus, it requires a lesser compression step to compress it back up to 350 to 550 psia. It should be further understood that alternately the two-phase gaseous stream of the second mixture may enter the inlet of a second compressor as will be described hereinafter.

While the stream in conduit 376 enters the downstream stage of compressor 330, the gaseous recycle stream of the second mixture in conduit 20 is recycled back to the upstream end of the compressor 330. It should be appreciated that the stream in conduit 20 has similar thermodynamic properties to those previously described for the stream exiting through conduit 20 in FIG. 1. The stream exiting conduit 20 into the upstream end of compressor 330 is at approximately a pressure of 1 to 5 atmospheres thus explaining its entrance into the compressor 330 at the upstream end thereof. The combined second mixture gaseous streams in compressor 330 exit said compressor 330 as a pressurized gas of approximately 350 to 550 psia.

In an alternate embodiment, the second mixture stream in conduit 20 enters a first compressor and is compressed to a pressure equal to that in the second mixture gaseous stream in conduit 376. Thence, the stream exiting the first compressor is combined with the stream in conduit 376 and together they enter a second compressor where the gas is pressurized to 350 to 550 psia. Other embodiments employing more than two compressors may also be employed. Thus, the alternate embodiment described herein is given by way of illustration and is not inclusive.

Figure 3:
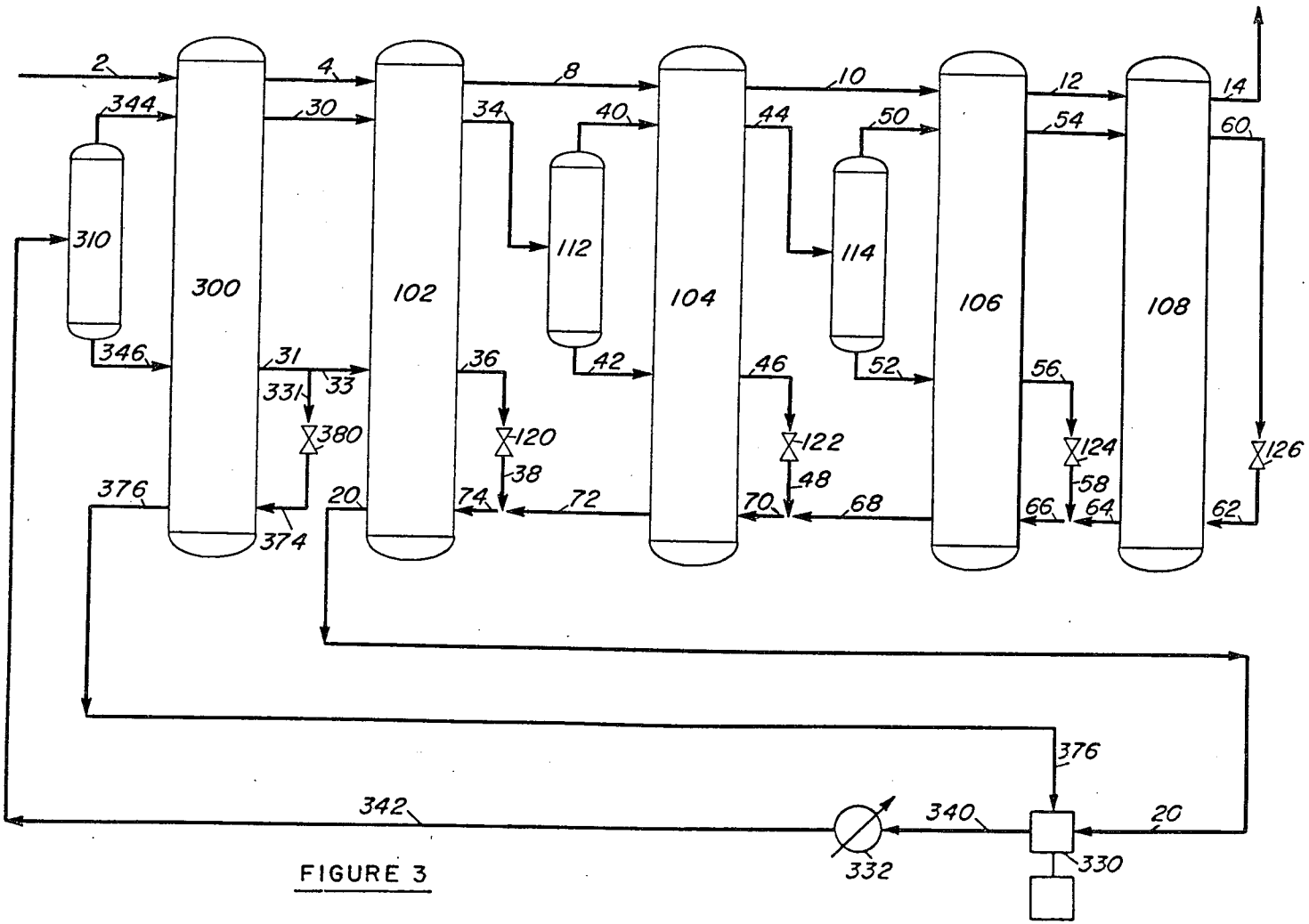
FIG. 3 is a flow diagram of a multicomponent refrigeration cycle with cooling in the first heat exchange stage provided by an expansion and recycle of the second mixture liquid exiting the first heat exchange stage.

The remainder of the process steps in the embodiment illustrated in FIG. 3 are similar to those previously described in the embodiments illustrated in FIGS. 1 and 2. Therefore, the numbers assigned to the various streams, apparatus and the like in FIG. 3 are the same as those used in FIGS. 1 and 2. Hence, the temperatures, pressures and phases described to similarly numbered streams, apparatus and the like are applicable to this embodiment subject to the comments made previously as to their approximate applicability.

Figure 4:
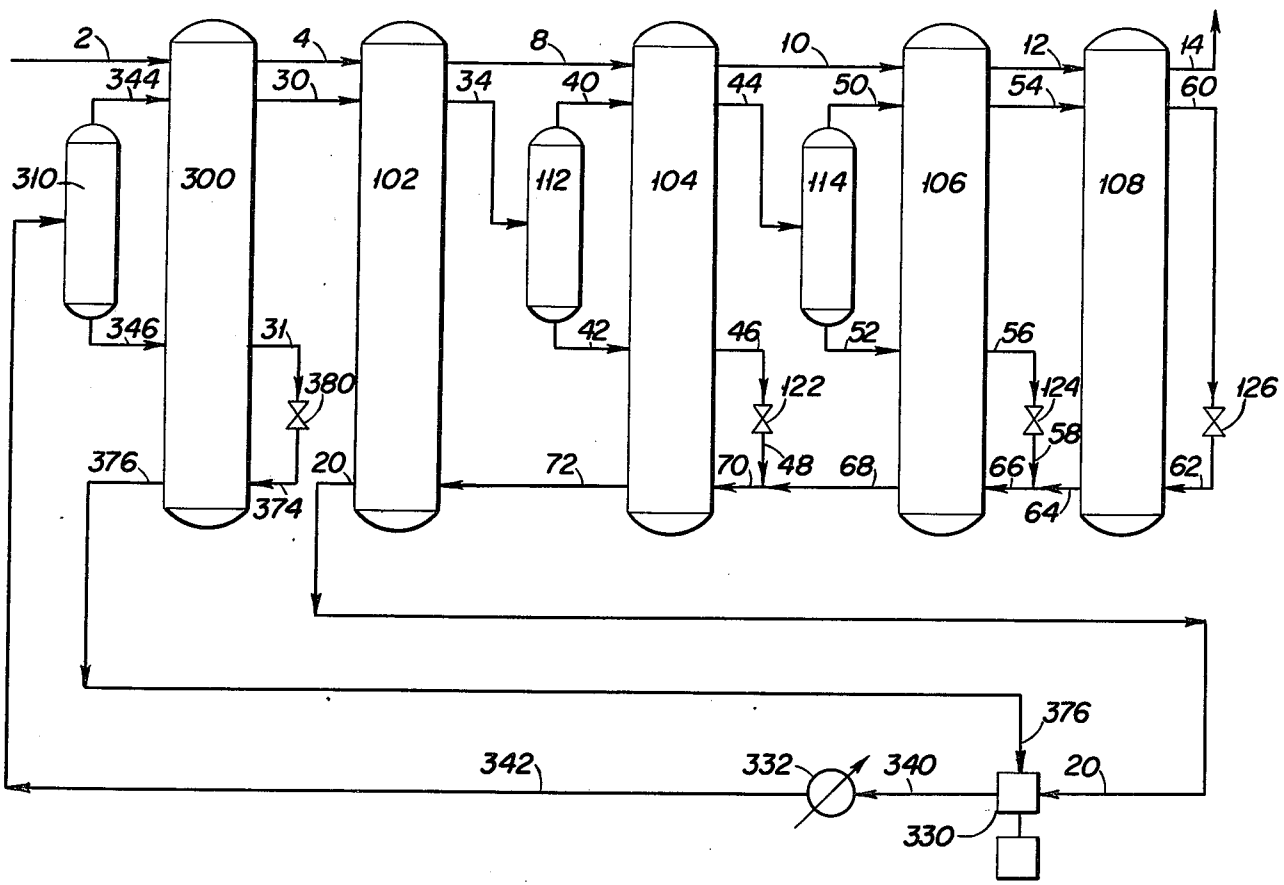
FIG. 4 is a flow diagram of the multicomponent refrigeration cycle of FIG. 3 modified to use all the liquid exiting the first heat exchange stage as a refrigerant for the first stage.
Figure 5:
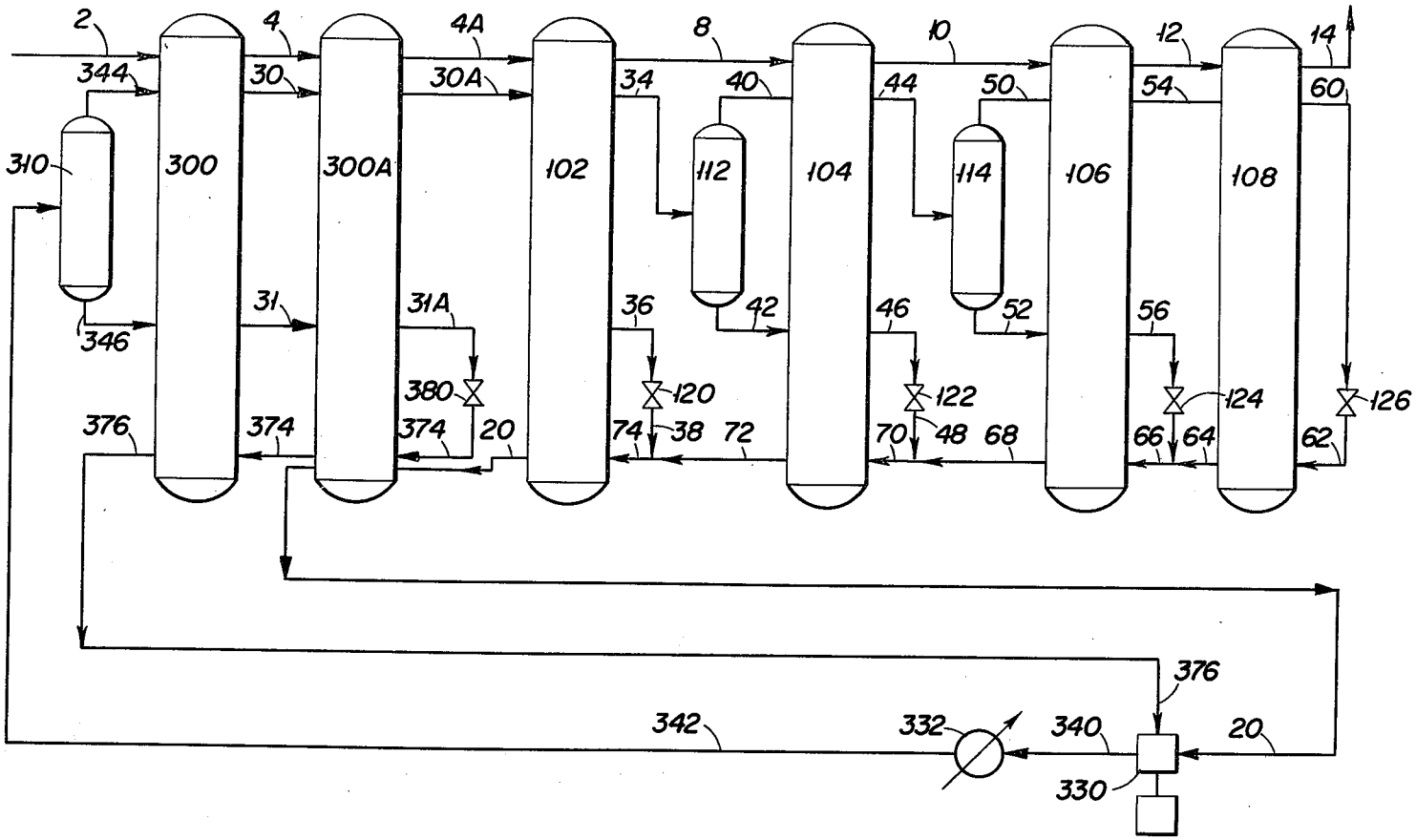
FIG. 5 is a flow diagram of a modification of the refrigeration cycle of FIG. 4.

FIGS. 4 and 5 show modifications of the basic embodiment just discussed with reference to FIG. 3. In FIG. 4, the liquid phase exiting stage 300 in conduit 31 is not divided as in FIG. 3 but instead is flashed through expansion valve 380 and returned directly to stage 300 in countercurrent flow to the incoming streams to provide cooling. This is distinguished from the embodiment of FIG. 3 where, as has previously been stated, only 10 to 40 percent of the liquid phase exiting in conduit 31 was recycled through stage 300 for cooling. Since none of the liquid phase from stage 300 continues to stage 102, all the cooling in stage 102 is provided by the recirculating second mixture through line 72. In other respects, the process is the same as that illustrated in FIG. 3.

FIG. 5 illustrates a modification of FIG. 4 in which an additional cooling stage, 300A, is introduced between stage 300 and stage 102. In practice, stages 300 and 300A might be physically merged, but they are illustrated separately here for clarity. In FIG. 5, the liquid phase stream exiting stage 300 via conduit 31 enters 300A as does the vapor phase which left stage 300 through conduit 30 and the natural gas feed leaving via conduit 4. In this respect, stage 300A acts as a secondary portion of stage 300. In addition, the liquid phase exits stage 300A through line 31A and is totally returned to stage 300A after expansion in valve 380, thereby providing cooling for both stage 300A and stage 300 and then returning through conduit 376 to compressor 300 as in FIG. 4. In the modification of FIG. 5, however, the second mixture refrigerant leaving stage 102 after removing heat from incoming streams, instead of returning directly to compressor 330 at its lowest suction pressure, passes into stage 300A and absorbs additional heat therein, partially warming before being returned to the suction of the compressor 330. It will be appreciated that this warming does not proceed to ambient temperature, but solely to an intermediate temperature. This modification of FIG. 4 permits an additional adjustment of the refrigeration cycle in order to most closely match the cooling curves to the warming curves, and thereby to obtain improved thermal efficiency.

It should be understood that the above preferred embodiments may be modified without departing from the scope and spirit of the invention. Thus other temperatures, pressures and phase conditions may be employed to achieve optimum operating conditions depending upon the particular circumstances under which the natural gas is to be liquefied. Furthermore, the number of heat exchange stages employed in the preferred embodiments is illustrative and not limiting. Hence, more or less than five heat exchange stages may be used without departing from the scope of the invention.

What is claimed is:

1. A method of cooling and liquefying natural gas in a first stage by a first multicomponent refrigerant and thereafter further cooling and liquefying said natural gas in a second stage by a second multicomponent refrigerant, the heat removed by said refrigerants in said first and second stages being discharged by compressing and condensing said refrigerants by indirect heat exchange against environmental cooling streams comprising the steps of:

a. precooling said natural gas to essentially ambient temperature by indirect heat exchange against at least one of said group of environmental cooling streams consisting of air and water and thereafter;

b. separating the combined first and second refrigerants into a vapor stream and a liquid stream;

c. cooling below ambient temperature in said first stage said natural gas and the vapor and liquid streams of (*b*) by indirect countercurrent heat exchange against said first refrigerant which exits said first stage after being warmed therein to near ambient temperature;

d. expanding to lower pressure and returning all of said liquid stream of (*b*) after cooling in step (*c*) directly to said first stage as said first refrigerant;

e. further cooling and liquefying said natural gas and the second refrigerant consisting of the vapor stream of (*b*) in said second stage by indirect countercurrent heat exchange against said second refrigerant which thereafter exits said second stage after absorbing heat therein at a temperature below that of said natural gas entering said second stage and without significant intervening temperature change is compressed and combined with the warmed first refrigerant from said first stage and thereafter the combined refrigerants are further compressed and cooled to near ambient temperature by indirect heat exchange against at least one of said group of environmental streams consisting of air and water, said combined refrigerants thereafter being separated into vapor and liquid phases in step (*b*), thereby completing the refrigeration cycle.

2. A method of cooling and liquefying natural gas in a first stage by a first multicomponent refrigerant and thereafter further cooling and liquefying said natural gas in a second stage by a second multicomponent refrigerant, the heat removed by said refrigerants in said first and second stages being discharged by compressing and condensing said refrigerants by indirect heat exchange against environmental cooling streams comprising the steps of:

a. precooling said natural gas to essentially ambient temperature by indirect heat exchange against at least one of said group of environmental cooling streams consisting of air and water and thereafter;

b. separating the combined first and second refrigerants into a vapor stream and a liquid stream;

c. cooling below ambient temperature in said warm first stage said natural gas and the vapor and liquid stream of (*b*) by indirect countercurrent heat exchange against said first refrigerant which exits said first stage after being warmed therein to near ambient temperature;

d. expanding the lower pressure and returning all of said liquid stream of (*b*) after cooling in step (*c*) to said first stage as said first refrigerant;

e. further cooling and liquefying said natural gas and the second refrigerant consisting of the vapor stream of (*b*) in said second stage by indirect countercurrent heat exchange against said second refrigerant which thereafter exits said second stage after absorbing heat therein at a temperature below that of said natural gas entering said second stage and being partially warmed in said first stage to a predetermined temperature below ambient and then is compressed and combined with the warmed first refrigerant from said first stage and thereafter the combined refrigerants are further compressed and cooled to near ambient temperature by indirect heat exchange against at least one of said group of environmental streams consisting of air and water, said combined refrigerants thereafter being separated into vapor and liquid phases in step (*b*), thereby completing the refrigeration cycle.

* * * * *